United States Patent [19]

Tisma

[11] Patent Number: 4,578,929

[45] Date of Patent: Apr. 1, 1986

[54] AUTOMATIC FORM AND FILL PACKAGING MACHINE USING CARDBOARD BLANKS

[75] Inventor: Steven Tisma, Chicago, Ill.

[73] Assignee: Tisma Machine Corporation, Chicago, Ill.

[21] Appl. No.: 580,664

[22] Filed: Feb. 16, 1984

[51] Int. Cl.[4] ..... B65B 1/22

[52] U.S. Cl. ..... 53/525; 53/251; 53/374; 53/563; 53/579

[58] Field of Search ..... 53/250, 251, 374, 375, 53/377, 379, 525, 563, 578, 579; 198/631, 706, 802

[56] References Cited

U.S. PATENT DOCUMENTS

| | | | |
|---|---|---|---|
| 1,706,534 | 3/1929 | Malone | 53/374 |
| 2,236,890 | 4/1941 | Bower et al. | 53/525 |
| 3,064,405 | 11/1962 | Gentry | 53/579 |
| 3,381,445 | 5/1968 | Vogt | 53/579 |
| 3,382,644 | 5/1968 | Vogt | 53/563 |
| 3,461,642 | 8/1969 | Langen et al. | 53/563 |
| 3,977,306 | 8/1976 | Flynn | 53/375 |
| 3,990,209 | 11/1976 | Eisenberg | 53/525 |
| 4,196,563 | 4/1980 | Gabrielson et al. | 53/579 |

*Primary Examiner*—John Sipos
*Assistant Examiner*—Donald R. Studebaker
*Attorney, Agent, or Firm*—Laff, Whitesel, Conte & Saret

[57] ABSTRACT

A unitary form and fill machine for wide throat boxes comprises a magazine for storing a plurality of preformed blanks. A plurality of lower mandrels are mounted on a first endless conveyor to travel throughout the machine. The blanks are picked up from the magazine one at a time and layed down on an individually associated one of the lower mandrels. A plurality of upper mandrels are mounted on a second endless conveyor which extends along a first part of the distance travelled by the first conveyor, the upper and lower mandrels and the first and second conveyors are synchronized so that the mandrels fit together and travel in alignment along said conveyors with the blank held between them. Various plows and other blank folding means are positioned adjacent conveyors for folding and sealing end flaps to form the blank into the bottom of a wide throat box. A third conveyor extends above the first conveyor along a second part of the distance travelled by the first conveyor. A plurality of filling chutes are attached to the third conveyor. The filling chutes and the lower mandrels and the first and third conveyors are synchronized so that the fill chute is over and travels in alignment with the wide throat of the boxes. After the wide throat box leaves the area of the third conveyor, a glue gun sprays panels which bonds the top in place.

10 Claims, 15 Drawing Figures

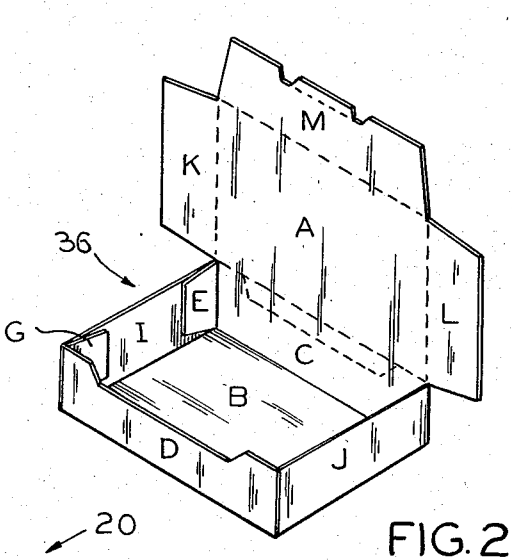
FIG.3
FIG.2
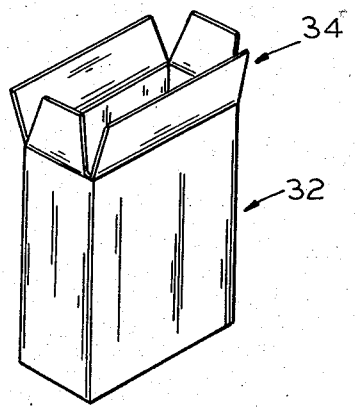
FIG.1
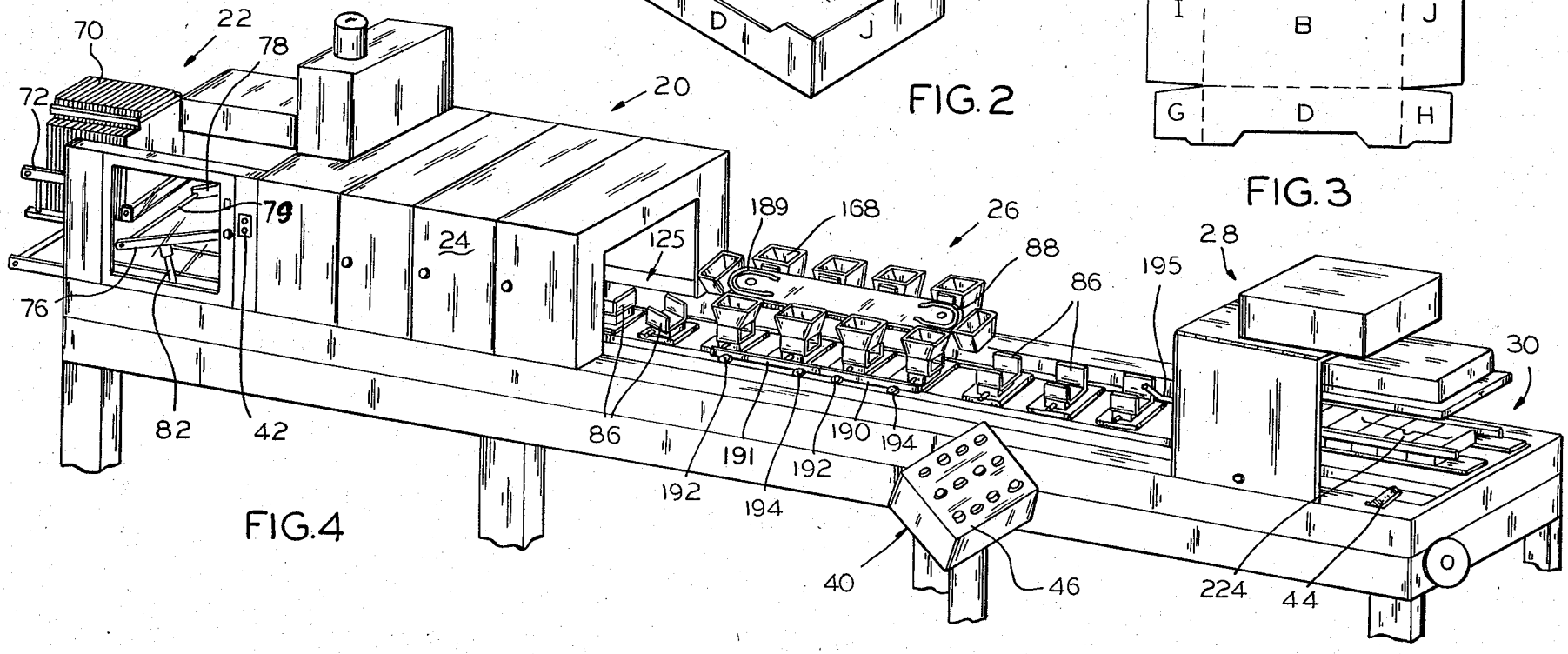
FIG.4

AUTOMATIC FORM AND FILL PACKAGING MACHINE USING CARDBOARD BLANKS

This invention relates to automatic form and fill packaging machines using pre-cut cardboard blanks and, more particularly, to unitary machines which automatically form wide throat cartons from pre-cut, but unfoled, blanks and which move them through a filling station to final sealing and delivery.

There are existing machines which form and fill tall, thin boxes which might hold a finely divided product, such as dry rice, peanuts, small candies, or the like. Because they are finely divided, these products fall into place within the box and there are no problems in the filling process. However, if one attempted to use the same machine to place large products in the same tall, thin boxes, those products would tend to form bridges within the boxes and prevent proper and complete filling.

As a result, the boxes (called "wide throat boxes") for these larger products are generally set on their largest side panel. The opposite top panel is a flap which stands open so that the box may be filled without obstruction from previously deposited products. Even so, it is common practice to shake the wide throat box as it is being filled to prevent the product from becoming an upstanding heap which rises above the level of the closing flap. After the product shakes down below the level of the top, the flap is closed and glued or otherwise bonded in place.

Heretofore, the common practice has been for the packager to have a number of different machines when wide throat boxes are to be formed and filled. One machine folds the pre-cut blanks to form the wide throat boxes. Another machine fills the formed boxes. Yet another machine closes and seals the boxes, delivering the final package to an output area. If it was desirable to avoid having to manually handle the boxes as they move between machines, it was necessary to construct complicated and custom designed conveyor systems. When this is done, there is an expensive installation cost and the factory space becomes dedicated to a particular layout. It is then very difficult to move the production line if changing production needs requires a different plant layout.

Accordingly, an object of the invention is to provide new and improved unitary fold and fill packaging machines. In particular, an object is to provide unitary packaging machines which form and fill wide throat boxes made from pre-cut blanks. Here, an object is to carry the formed boxes, without interruption, through a fill station and a seal station to a final delivery point. In this connection, an object is to enable the final delivery of filled boxes to be configured to fit the floor space and layout in a factory, even though the same unitary machine is used.

Another object is to provide unitary machines for forming boxes and then filling them with bulky objects which must be shaken down during the filling sequence.

In keeping with an aspect of the invention, a machine begins with a magazine filled with pre-cut and plastic coated blanks which are picked up, one at a time, and deposited on a conveyor belt having a series of box forming mandrels attached thereto. The blank is folded to form the bottom of a large throat box and then heated to fuse the plastic coating at the ends of the box where forming flaps bond together to make the box. The boxes may be rotated to any desired position and moved through a shaker table to accept the product, which is shaken down during a filling step. Thereafter, the box may again be turned (depending on its position during the filling step) as the top and its associated flaps are glued down.

A preferred embodiment of the invention is shown in the attached drawings, wherein:

FIG. 1 shows a narrow throat box which has been made and filled on prior art fold and fill, packaging machines;

FIG. 2 shows a wide throat box which may be made and filled on the inventive machine;

FIG. 3 is a plan view of a blank which might be used to make the box of FIG. 2;

FIG. 4 is a perspective view of the inventive fold and fill packaging machine;

Figure 5:
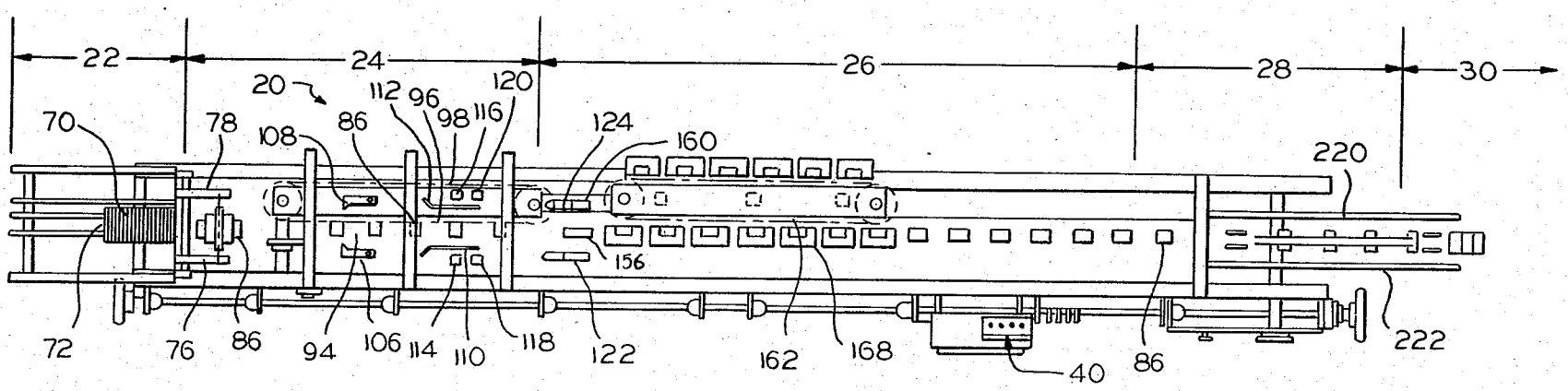
FIG. 5 is a top plan view of the inventive machine of FIG. 4.
Figure 6:
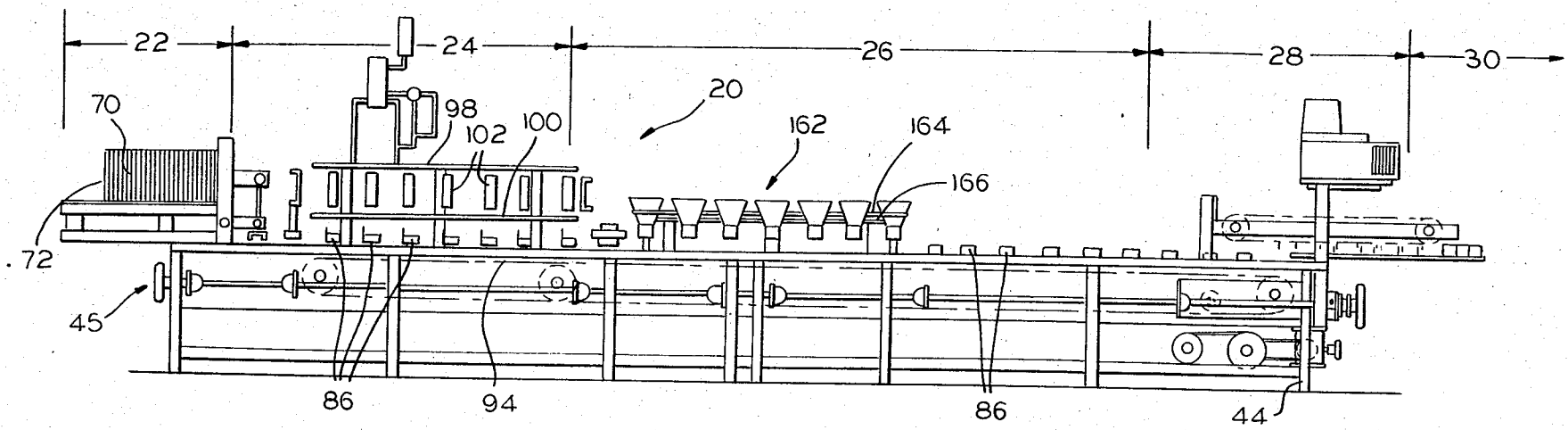
FIG. 6 is a side elevation of the inventive machine of FIG. 4.

The inventive fold and fill packaging machine 20 of FIGS. 4–6 includes a magazine 22 for vertically storing and feeding pre-cut, plastic coated blanks to the bottom forming and sealing station 24. After the bottom is so formed, they move onto station 26 where they are filled with any suitable product. In this station, the boxes are shaken so that the product settles to a level which enables the top to close. Thereafter, the filled boxes move to a top forming and gluing station 28, from which they are discharged at 30.

Heretofore, machines with this general design have been limited to narrow throat boxes 32, such as that shown in FIG. 1 where the product must be poured into a relatively small end opening after which end flaps 34 are closed. If the product is finely divided, there is no problem. For example, peas or peanuts could be poured into the end opening with no problem. On the other hand, if french-fries, or the like, were to be poured through such a narrow end opening, they would tend to bridge the space within the box and might prevent a complete fill.

Therefore, it is desirable to provide a wide throat box 36 as shown in FIG. 2, wherein the product cannot bridge the opening. The difficulty with a box such as this is that it is most difficult to fold a blank and manipulate the box in a single machine. Therefore, in the past, forming and filling of this type of box has required separate machines to perform the various functions represented by the individual stations 22–30 in FIG. 2. It was necessary either to hand load the individual machines or to transport the products between the machines by custom built conveyors. Both of these options were very expensive.

FIG. 3 shows a more or less conventional blank of a type which might be used for forming the box of FIG. 2. Dashed lines indicate where the blank may be folded to form the box. This blank has a top panel A and a bottom B with a side panel C formed therebetween. An opposite side panel D is formed on the outside edge of bottom panel B. Four dust flaps E–H extend from the opposite ends of the two side panels C, D. Two major end panels I, J extend from opposite ends of the bottom panel B, and two major end panels K, L extend from opposite ends of the top panel A. A side cover flap M is attached to the outside edge of the top panel A in order to seal against side D and close the box. An irrelevant tear tab N is shown in this particular blank to facilitate a removal of the top which enables a rise of this particular box as a dish.

The sequence of folding for box formation is for side panels C, D to be folded up, perpendicular to the bottom panel B. Then, the four dust flaps E–H are folded in toward each other, with their edges over the crease lines between the ends of the bottom panel B and the major flaps I, J. Next, the major flaps I, J, are brought up and bonded to the dust flaps E–H, thereby completing the bottom of the box.

The box is filled and then the top A is folded at the crease line between it and side panel C. The top A is brought down to a spaced parallel relationship with respect to the bottom panel B, thereby closing the box. A small amount of glue is sprayed on the outside surface of major flaps I, J and the side panel D. The major flaps K, L and the side cover flap M are folded down and glued in place over the bottom of the box.

The inventive machine is designed to fold these panels and flaps and to bond them together in the described manner, thereby completing a sealed box. The box is filled after the bottom is completely formed and bonded and before the glue is sprayed prior to the closing of the top.

In operation, the machine of FIG. 4 is controlled from a console 40. One or more emergency stop buttons may be located around the machine. A mechanical clutch lever 44 engages a mechanical drive assembly 45 (FIG. 6). The emerging stop button 42 may be located at any convenient spot where a worker may wish to seize control over the machine if there is a malfunction. In the example shown in FIG. 4, the emergency button 42 is in the heat sealing area, and perhaps, elsewhere, where a workman might want to immediately seize control over the machine. The lever 44 controls a clutch which opens on over load conditions to relieve the strain on various mechanical drive elements (45, FIG. 6). After a jam or other overload condition is relieved, the lever arm 44 is moved to close the clutch so that the machine may again operate.

Figure 7:
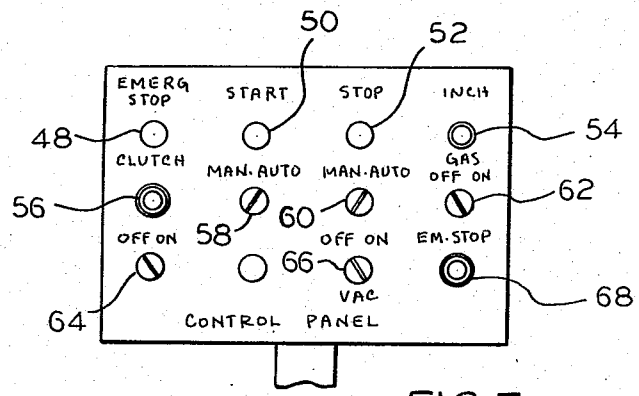
FIG. 7 is a plan view of a control panel for the machine of FIG. 4.

The details of control panel 46 for the console 40 are shown in FIG. 7. The top row of controls include another emergency stop button 48, a start button 50, a regular stop button 52, and an inching button 54, which enables a worker to move the entire machine in very short incremental steps for maintenance purposes. A pilot lamp 56 lights when the clutch controlled by lever 44 opens.

Switch 58 enables an operation scale which weighs each batch of the product. Switch 60 places the machine on "automatic" during normal operation or on "manual" during maintenance or override operation. Switch 62 opens or closes a supply of gas to a burner head used to melt the plastic coating on the blank. The burner is in heat sealing station 24. Switch 64 enables the shaker to operate in the box filling area 26. Switch 66 opens and closes a vacuum line used to pick up and deliver blanks stored in magazine 22. A pilot lamp 68 lights whenever there is an emergency stop condition.

Figure 8:
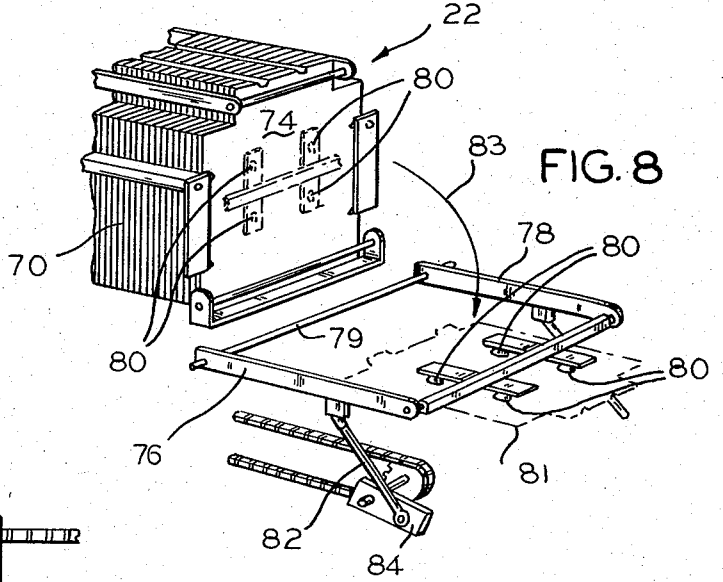
FIG. 8 shows a magazine filled with pre-cut, plastic coated blanks which are being inserted into the inventive machine.

The carton blank input to the machine begins with a magazine 22 (FIG. 8) where a stack 70 of pre-cut, plastic coated cardboard blanks are stood vertically on end. Each of these blanks is similar to that shown in FIG. 3. A spring biased pusher 72 (FIGS. 5, 6) moves the front blank 74 in the stack to a pickup position. At that position, there are a pair of lever arm 76, 78, one end of which are rotably mounted at 79 to swing from a position adjacent the front blank 74 to a laid down horizontal position 81 at the beginning of the box formation. A plurality of vacuum cups 80 are attached to and supported by the free ends of arms 76, 78. When the vacuum cups engage the front surface of the blank 74, a vacuum is drawn to pickup and carry the blank from the vertical position over the arc 83 to the horizontal position. Then, the arms 76, 78 return to pickup and carry the next blank. The arms 76, 78 is pulled and pushed by a rod 82, which in turn, is connected to the end of a rotating lever 84 driven from the general mechanical drive (45, FIG. 6) for the system.

Figure 9:
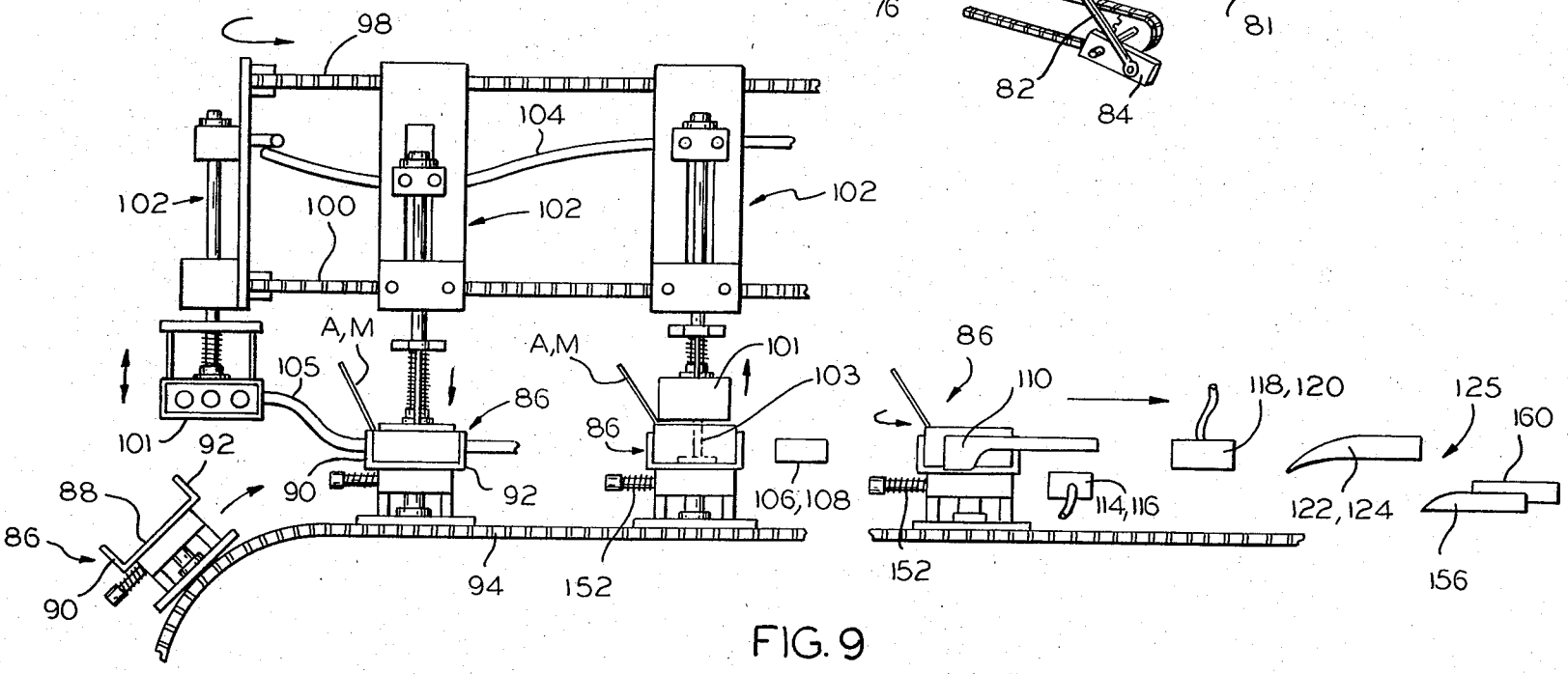
FIG. 9 is a front elevation view showing of a station for forming the bottom of the box with upstanding top flaps.

The blanks delivered from the magazine 22 are laid down in a horizontal position with the bottom panel B (FIG. 3) over a lower or bottom pocket shaped forming mandrel 86 (FIG. 9). A plurality of these lower packet mandrels are connected in a uniformly spaced apart series along two spaced parallel bicycle chains 94, 96 which together form an endless conveyor extending over almost the entire length of the machine.

The lower pocket mandrel 86 (FIG. 10) has a flat bed 88 with two upstanding end flanges 90, 92, that give it an appearance faintly resembling a bed with a headboard and footboard which together form the pocket. These pockets hold the empty boxes in an upright position throughout their journey through the inventive machine. The internal mechanical drive mechanism of the machine is designed to always position the bed 88 of one of the lower mandrels 86 under the bottom panel B (FIG. 3) of the blank, as it is laid down in horizontal position 81 (FIG. 8) by the vacuum cups 80, at the bottom end of the arc 83.

Above the lower mandrel conveyor chains 94, 96 is a second set of bicycle chain conveyor chains 98, 100. A plurality of upper mandrels 102 are attached in a uniformly spaced series to the conveyor chains 98, 100, the spacings exactly corresponding to the spacings of the lower mandrels 86. The bottoms of the upper mandrels are flat plates 101 the size and shape of the lower mandrel bed 88. Upper mandrels 102 are arranged for reciprocal movement in a vertical direction responsive to engagement with an upper rail or lift cam 104 which extends along the path followed by conveyor chains 98, 100. A hold down or retainer member 103 is built into the upper mandrel and is raised or lowered by a lower rail or lift cam 105. Thus, in the area where the upper mandrel 102 approaches a conjunction with the lower mandrel 86, the cam rails 104, 105 lower the upper mandrel 102 and the hold down or retainer member 103 into engagement with the bottom panel B of the blank resting on the lower mandrel 86.

In operation, the flat plate of the upper mandrel 102 pushes the bottom panel B of the blank downwardly and onto the bottom bed 88 surface of the lower mandrel 86. The end flanges 90, 92 of the lower mandrel fold side panels C, D of the blank upwardly and the bottom box shape is held between the upstanding flanges responsive to the downward movement of plate 101 under the guidance of side rail cam 104. Later, in preparation for a heat sealing step, rail 104 raises mandrel plate 101 while the hold down or retainer 103 remains in a lowered position until it next engages a bottom rail or cam 105 (not shown) at which time retainer 103 raises.

As lower and upper mandrels 86, 102 (i.e. hold down 103) hold bottom panel B of the box, the conveyors 94, 96, 98, 100 advance to a pair of kicker arms 106, 108 on opposite sides of the conveyor to close the dust flaps E–H so that they stand perpendicularly above the bottom panel B of the box. At this time, the major flaps I, J project out mandrel 86 horizontally from and in the plane of bottom panel B.

At this point, the lower mandrel 86 moves between two guides 110, 112 having plows which are curved outwardly at the front to engage and hold the closed dust flaps. Guides 110, 112 run parallel to the conveyors and hold the dust flaps E–H of the box in a position which corresponds to the ends of the forming box. These guides are relatively wide at their leading ends, which the box engages first, as it is carried along by conveyors 94, 96, 98, 100. After the leading ends, the guides thin to enable a heater to reach the box.

The interior of the box may support a food product; therefore, it is coated with a plastic which conforms to public health standards. This plastic is thermal setting and becomes tacky when heated. Four heating elements 114–120 are positioned in opposed pairs adjacent the guides 110, 112 and in an area where they confront the blank as it moves along the conveyors 94, 96, 98, 100. These heating elements may be any suitable devices, such as a gas burner for either natural gas or propane gas. Two of the heaters 114, 116 project a flame horizontally to melt the plastic coating on dust flaps E–H to a point where they become tacky. The other two heaters 118, 120 project a flame vertically to melt the plastic coating, also to a tacky state, on major flaps I, J which project from the mandrels.

A continued movement of the conveyors 94–100 bring the forming box to a pair of plows 122, 124 extending parallel to and on opposite sides of the conveyors. The front ends of the plows extend downwardly below the major flaps I, J which are extending horizontally in the plane of the bottom panel B. Therefore, the plows 122, 124 lift the major flaps to an upright position where they fit snuggly between and are held by the guides 122, 124. These guides include water cooled jackets. Therefore, the partially melted, still tacky plastic surfaces on dust flaps E–H and major flaps I, J come together and, as they are cooled, cement and bond together to form the sealed ends of the box.

The bottom of the box is now fully formed, and it is rigid enough to be held by the lower mandrel, acting alone. Therefore, the hold down or retainer 103 of the upper mandrel is lifted out of the box by a side rail similar to rail 105, as the conveyor chains 98, 100 carry the mandrel past the lifting cam rail. The upper mandrel 101 was earlier lifted above the box by rail 104.

The box has now reached the filling station. The next step depends upon the box being formed and the product being placed in the box. Sometimes, it is desirable to fill the box while it is travelling with its long dimension parallel to the line of travel and other times it is better to fill it while the long dimension is perpendicular to the line of travel. Therefore, the invention provides a means for rotating the box (as shown at 125 in FIG. 4) if it is desirable to do so.

Figure 10:
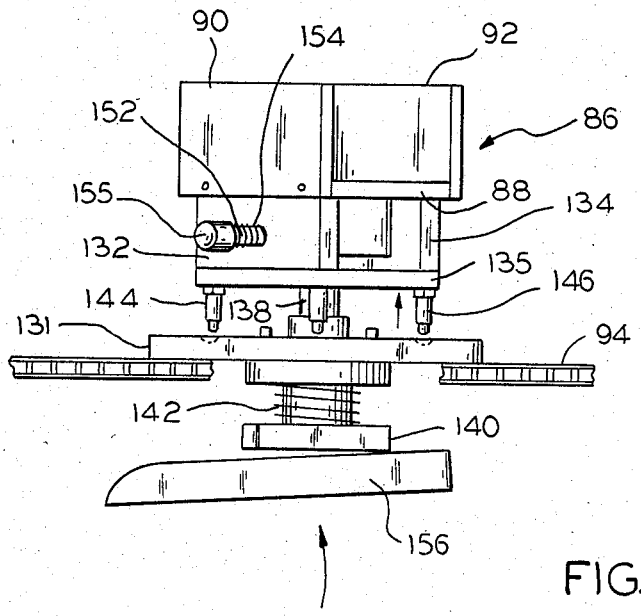
FIG. 10 is a perspective view of a bottom forming mandrel which holds the box when it is formed and thereafter throughout the filling process, and which enables the box to be turned and shaken, as desired, while it moves through the inventive packaging machines.

To understand how the box is rotated, reference may be made to FIG. 10. On one side of the mandrel 86, is a plate 131 which is connected to the conveyor chains 94, 96 in any suitable manner. A vertical pair of spaced parallel plates 132, 134 are connected between opposite horizontal plates 88, 135. A shaft 138 having a circular cross section is connected from the bottom of the mandrel 86, through holes in plates 131, 135, and below the plate 131, to an arm 140, which is attached to the bottom of shaft 138. A hold down compression spring 142 urges the mandrel 86 to a lower position (as viewed in FIG. 10). When the arm 140 is pressed upwardly, and rotated, the mandrel 86 is rotated. Two locator pins 144, 146 fit into holes in plate 131 and hold the mandrel 86 in a predetermined position, after arm 140 is released and spring 142 returns the mandrel 86 to the lowered position. If the mandrel 86 is rotated to some other position, the locator pins 144, 146 fall into locator holes at some other position in the plate 131.

Therefore, a formed box setting on bed 88 and between the flanges 90, 92 may be rotated to any suitable position depending upon the needs of the various steps in the form and fill cycle. Once rotated and released, the locator pins 144, 146 hold the mandrel in the selected position until arm 140 is again raised and rotated.

Figure 11:
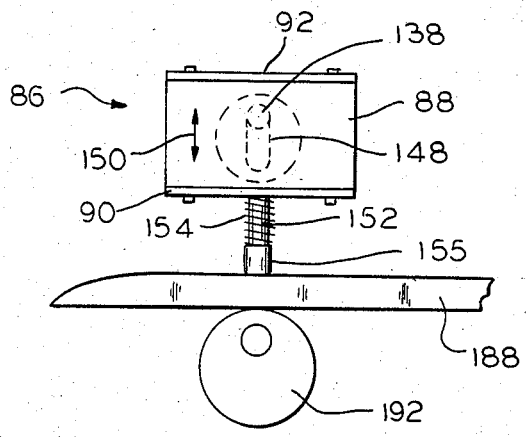
FIG. 11 is a schematic top view of the rotating and shaking mandrel of FIG. 10, showing how it may be moved back and forth to shake the box as it is being filled.

Another feature of the mandrel 86 is shown in FIG. 11 which enables it to undertake a limited reciprocating excursion. At the point where the shaft 138 passes through the plate 131, there is an elongated hole 148 which enables the mandrel to move laterally as indicated by the double ended arrow 150. A pin 152 supports a compression spring 154 urging the shaft 138 supporting the mandrel 86 to the upper end of elongated hole 148. The end of pin 152 is covered by a wear resistant cap 155, such as a nylon cap, for example. When the distal or capped end of pin 152 is pushed, the spring 154 is compressed and the mandrel 86 moves upwardly so that the lower end of the slot 148 engages and is stopped by shaft 138. When the pin 152 is released, the spring 154 causes the mandrel 86 to return to the position shown which is fixed by shaft 138 engaging the upper end of the hole 148.

In FIG. 9, the lower mandrel 86 is shown as travelling in a direction which places the pin 152 parallel to the path travelled by the mandrel. This means that side C of the FIG. 3 blank is in engagement with mandrel plate 90 and side D is in engagement with plate 92. The top A of the box is in a travelling position, with its wide dimension perpendicular to the path of travel.

As it moves along the conveyor 94, 96, the arm 140 on the bottom of the mandrel 86 engages a nylon plow 156 which lifts it against the compression bias of spring 142. The locator pins 144, 146 are lifted out of their mating locator holes. Then, an end (FIG. 8) of arm 140 is pushed by a second plow 160, thereby causing it to rotate the shaft 138 by 90°. When the mandrel 86 moves further, arm 140 drops off the end of plow 156, spring 142 lowers the mandrel. The locator pins 144, 146 center in new locator holes in plate 131. Now, the box is rotated by 90° relative to its former position so that the box top A is now on the side, parallel to the path of travel. It should now be obvious, that the mandrel 86 may be rotated to any convenient position depending upon the location and shape of plow 160.

Figure 12:
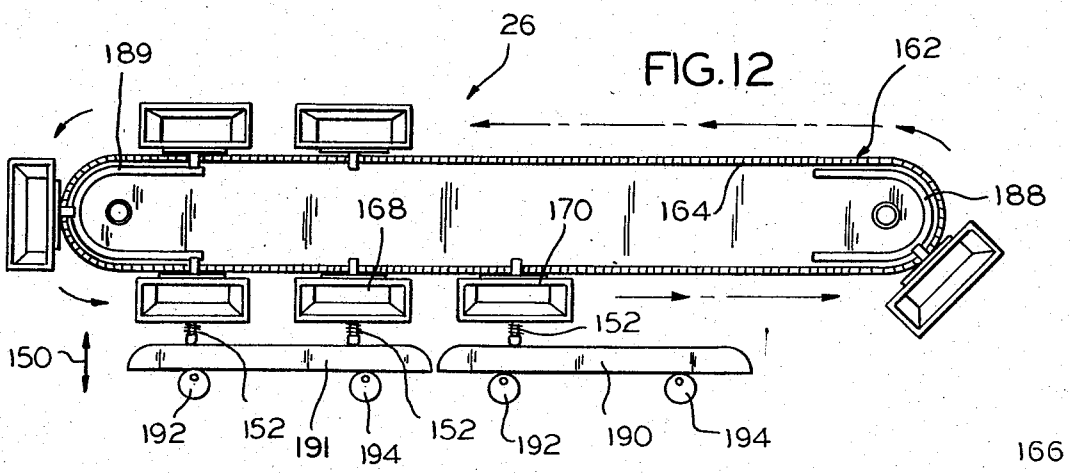
FIG. 12 is a plan view of a fill station.

FIG. 12 is a top plan view of a conveyor 162 at the fill station, the conveyor comprising upper and lower bicycle chains 164, 166, which travel around an endless path.

Figure 13:
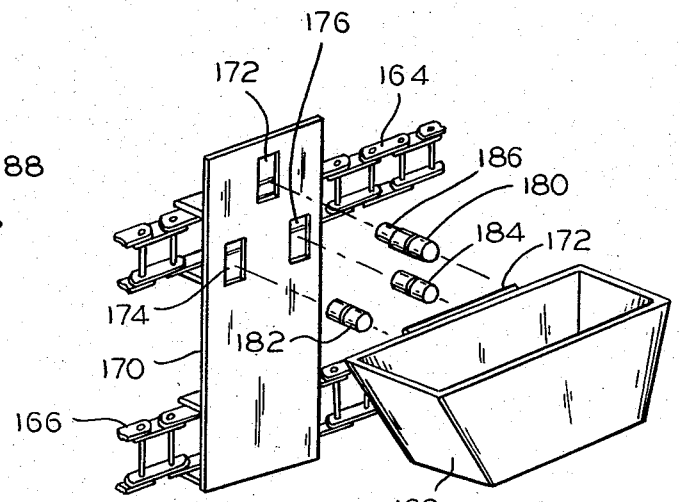
FIG. 13 is a perspective, partially exploded view showing a filling chute and its support structure.

A number of product feed chutes (one of which is numbered 168) are periodically attached in series around the conveyor chains 164, 166. The method of attachment is seen in FIG. 13. A back plate 170 is attached to the chains 164, 166 in a suitable manner. A second plate 172 is attached to chute 168. Three elongated holes 172, 174, 176 are formed in the plate 172. Attached to the plate 172 on the back of fill chute 168 are three locator pins 180, 182, 184 which travel up and down in the elongated slots 172, 174, 176, to provide vertical movement for the chute.

The pins 182, 184 are captured behind the plate 172 to stabilize the bottom of the chute and keep it from taking any significant amount of horizontal movement. The upper pin 180 ends in a wheel 186 is adapted to roll on side rails or cams 188, 189 (FIG. 12) extending along the conveyor chains 164, 166. Near the end of the conveyor, the side rails or cams raise; therefore, the wheel 186 (FIG. 11) also rasises to cause the pins 180–184 to slide to the tops of elongated slots 174–178. This lifts the feed chute high enough to enable the lower mandrel carrying the box to pass under it.

In a like manner, by installing a side rail, the chutes may be raised or lowered wherever it is convenient to do so.

Means are provided for filling the boxes. In greater detail, a scale (not shown) is positioned above the conveyor 162 to weigh the product by batch loads and then to release the batch load into a chute 168 as it moves past a fill station. The product falls, under gravity, through the chute and into a box.

Means are provided for shaking the boxes as they are filled. More particularly, while the box is being moved along the conveyor 162, the pins 152 on the lower mandrels 86 are pressed by springs 154 (FIGS. 11 and 12) into contact with fences 191, 190 (FIG. 10) that are adapted to move back and forth in the directions indicated by the double ended arrow 150. Each fence is moved by two eccentrically mounted pair of wheels 192, 194. Thus, as eccentric wheels 192, 194 rotate, fences 191, 190 vibrate to push and release the spring biased pins 152. This shakes the lower mandrel 86 and the box which it is carrying to faciliate filling and to help insure that the product does not heap above the level of the closed box top.

Figure 14:
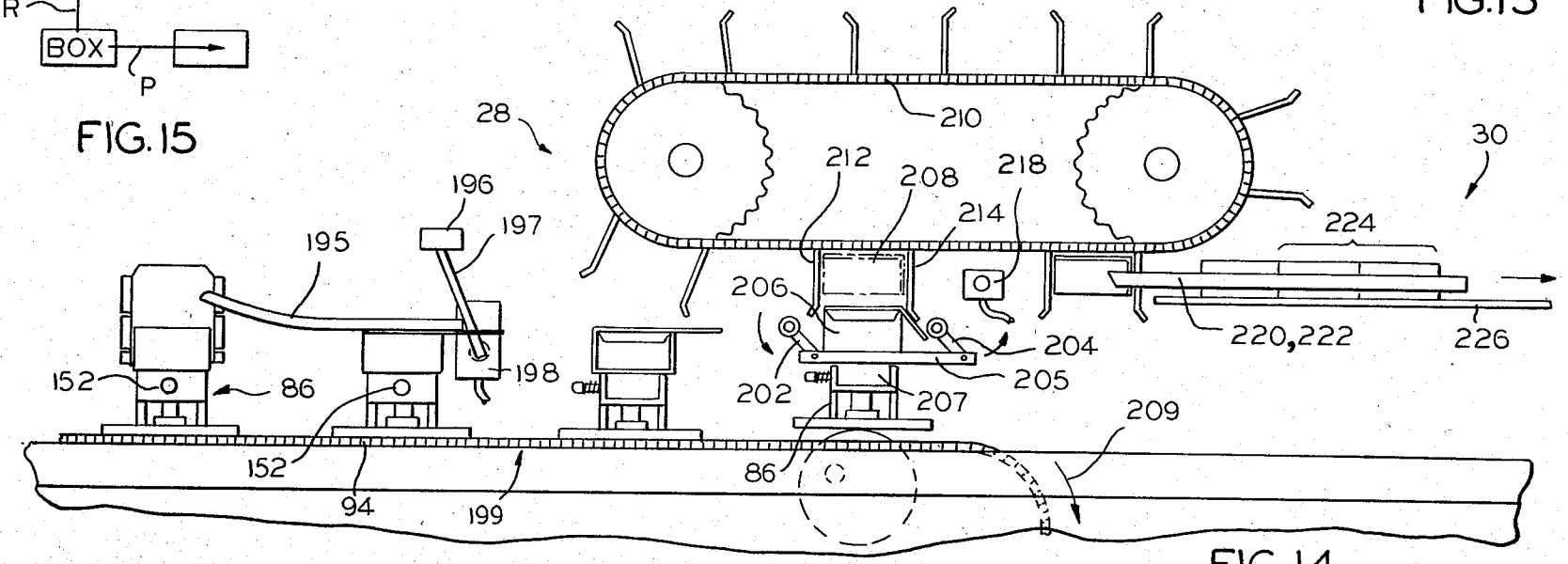
FIG. 14 is a side elevation view of a final station in the machine where tops are closed and sealed on the boxes, which are then delivered from the machine.

After the box is filled, the side cover flap M (FIG. 3) and top panel A engage a cam or elongated plow bar 195 (FIG. 14) having a shape which forces the top to close. A sensor 196 controlled by a feeler rod 197 detects whether a box is being carried by a lower mandrel. Responsive thereto, a glue gun 198 sprays a small amount of glue on the outside or front of side panel D. A lower mandrel rotating plow similar to plows 156, 160 (FIG. 9) may rotate the lower mandrel 86 and the box that it is carrying, if it is desirable to do so. This plow is the same as plows 156, 160, described above, and, if provided, is located at position 199 (FIG. 14).

An elevator mechanism 202, 204 raises the filled boxes and lifts them out of the lower mandrels 86 which have been carrying them since the start of the fold and fill process showin in FIG. 7. The elevator 202, 204 has two horizontally and inwardly directed flanges which are fit under the opposite ends of the box as it is being carried along by the lower mandrel. One of the flanges 205 is seen in FIG. 14. The other flange is in a spaced parallel relationship above the plane of the paper as viewed in FIG. 14. Each of these flanges is mounted on the ends of a pair of crank arms 202, 204. Therefore, as the cranks rotate as indicated by two arrows in FIG. 14, the ends of the crank arms connected to the flanges raise and lower the flanges. FIG. 14 has been drawn to show that the box 206 has been lifted from position 207 and is about to be deposited in position 208. The lower mandrel will now be carried down as indicated by arrow 209 and along the bottom of conveyor chains 94, 96 to the start of the bottom forming position at the left hand end of FIG. 9.

Above the lower mandrels 86 in the gluing station 28 (FIG. 14), is an endless conveyor 210 which has a plurality of spaced parallel fins 212, 214 extending therefrom. The space between the fins 212, 214 is sufficient to hold the box with side cover flap M (FIG. 3) pressed firmly against side panel D, while the glue, applied by glue gun 198, dries.

As the conveyor 210 carries the box past oppositely disposed glue guns at 218, a small amount of glue is sprayed on the outside of the major panels I, J. Plows 220, 222 close major flaps K, L on top A over major flaps I, J on bottom B. The plows 220, 222 hold these flaps in position long enough for the glue to set, after which the product is completely sealed inside the box.

Figure 15:
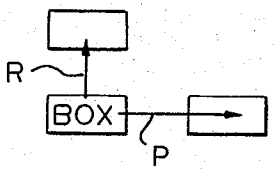
FIG. 15 schematically shows the alternative manner of discharging filled boxes from the machine.

The full boxes 224 push each other along a track 226 in the output or delivery zone 30 (FIG. 4) from which they may move over any convenient conveyor path, or the like. The track 226 may project straight out the end of the machine, in which case the boxes push each other longitudinally, as indicated by arrow P (FIG. 15). Or, it may be that delivery should be relocated, in any convenient manner, to fit a particular floor plan such as a 90° displacement from the position seen in FIG. 4. When this happens, the boxes push each other at right angles, as indicated by the arrow R (FIG. 15).

Those who are skilled in the art will readily perceive how to modify the invention. Therefore, the appended claims are to be construed to cover all equivalent structures which fall within the true scope and spirit of the invention.

The claimed invention is:

1. A unitary form and fill machine comprising magazine means for storing a plurality of pre-formed blanks, each of said blanks folding and forming a wide throat box when in a folded condition, a plurality of lower mandrel means for forming pockets mounted on a first endless conveyor means for travel through substantially all of said unitary machine, means for picking up said blanks one at a time from said magazine and laying them down on a corresponding one of said lower mandrels with which said laid down blank is individually associated as it travels through said machine, a plurality of upper mandrels mounted on a second endless conveyor means which extends along a first part of the distance travelled by said first conveyor means, said upper and lower mandrels and said first and second conveyor means being synchronized so that said mandrels fit together to fold and hold said boxes as they travel in alignment along said conveyor means, said lower mandrels thereafter carrying said boxes in an upright position through said machine, means for supporting and selectively rotating said lower mandrel to any suitable position for turning and selectively orienting the box being carried by said lower mandrel, locator means associated with said lower mandrel for thereafter holding said mandrel in said suitable position until said lower mandrel is next rotated on said rotatable means, means adjacent said first and second conveyor means for folding and sealing end flaps on said blank to form said blank into a bottom of a wide throat box, third conveyor means above said first conveyor means and extending along a second part of the distance travelled by said first conveyor means, a plurality of filling chute means attached to said third conveyor means, said filling chute means and said lower mandrels and said first and third conveyor means being synchronized so that said fill chute means is over and travels in alignment with said wide throat of said boxes as they are being carried by said lower mandrels, and means for sealing said wide throat box after it leaves the area of said third conveyor means.

2. A unitary form and fill machine comprising magazine means for storing a plurality of pre-formed blanks, each of said blanks folding and forming a wide throat box when in a folded condition, a plurality of lower mandrel means for forming pockets mounted on a first endless conveyor means for travel through substantially all of said unitary machine, means for picking up said blanks one at a time from said magazine and laying them down on a corresponding one of said lower mandrels with which said laid down blank is individually associated as it travels through said machine, a plurality of upper mandrels mounted on a second endless conveyor means which extends along a first part of the distance travelled by said first conveyor means, said upper and lower mandrels and said first and second conveyor means being synchronized so that said mandrels fit together to fold and hold said boxes as they travel in alignment along said conveyor means, said lower mandrels thereafter carrying said boxes in an upright position through said machine, said lower mandrel being mounted on rotatable means so that said lower mandrel may be rotated to any suitable position for turning the box being carried by said lower mandrel, locator means associated with said lower mandrel for thereafter holding said mandrel in said suitable position until said lower mandrel is next rotated on said rotatable means, means in each of said lower mandrels for enabling it to undertake a limited reciprocal excursion, means adjacent said first and second conveyor means for folding and sealing end flaps on said blank to form said blank into a bottom of a wide throat box, third conveyor means above said first conveyor means and extending along a second part of the distance travelled by said first conveyor means, a plurality of filling chute means attached to said third conveyor means, said filling chute means, said lower mandrels, and said first and third conveyor means being synchronized so that said fill chute means is over and travels in alignment with said wide throat of said boxes as they are being carried by said lower mandrels, vibrating means positioned along at least part of the path followed by said first conveyor means for shaking said lower mandrel by causing it to repeately undertake said reciprocal excursion, and means for sealing said wide throat box after it leaves the area of said third conveyor means.

3. The machine of claim 2 wherein said vibrating means is located in the second part of the distance travelled by said first conveyor means and adjacent said filling chute means.

4. The machine of claim 2 wherein said pre-formed blanks are at least partially coated with a thermosetting plastic, and wherein said sealing is accomplished by heater means for elevating the temperature of said plastic coating to a poinst where a tack occurs between folded flaps on said blank.

5. The machine of claim 4 wherein said heater means are gas burners directed toward selected portions of said blank where said tack occurs.

6. The machine of claim 2 and side rail cam means extending along at least some of the distance travelled by said first, second, and third conveyor means, and means responsive to said side rail and cam means for raising and lowering parts of said machine.

7. The machine of claim 6 wherein said side rail and cam means raises and lowers said upper mandrels.

8. A unitary machine for forming, filling, and sealing boxes, said machine comprising means for storing a plurality of blanks for forming wide throat boxes, blank support means mounted on a conveyor means for travel over a path through said unitary machine, said blank support means having a generally U-shaped pocket for holding an empty box in an upright position, a plurality of means for folding and forming said blanks into boxes as said U-shaped support means carrying said boxes travel through said machine, means for rotating said U-shaped supports at selectable positions along said path, said means for rotating said support means being a mandrel which is mounted to rotate independently of its conveyor means so that it may rotate said U-shape to any suitable position for turning the box and selectively changing its attitude as it is being carried by said mandrel, said rotation occurring at any selected area along said path, and locator means associated with said mandrel for thereafter holding said mandrel in said suitable position, shaking means associated with the mandrel for enabling it to undertake a limited reciprocal excursion, means extending along part of the distance travelled by said support means for filling said boxes as they are being carried by said support means, vibrating means positioned in a selectable area along said path where said boxes are filled for shaking said mandrel by causing it to repeatedly undertake said reciprocal excursion, and means for sealing said wide throat box after it leaves the area where said boxes are filled.

9. The machine of claim 8 wherein said blanks are pre-formed and at least partially coated with a thermosetting plastic, and wherein said means for sealing said boxes comprise gas burning heater means for elevating the temperature of said plastic coating to a point where a tack occurs between folded parts of said blank.

10. The machine of claim 9 and side rail cam means extending along parts of the distance travelled by said support means, and means responsive to said side rail cam means for raising and lowering parts of said machine in order to form and fill said box.

* * * * *

UNITED STATES PATENT AND TRADEMARK OFFICE

CERTIFICATE OF CORRECTION

PATENT NO. : 4,578,929
DATED : April 1, 1986
INVENTOR(S) : Steven Tisma

It is certified that error appears in the above—identified patent and that said Letters Patent is hereby corrected as shown below:

Col.1, Line 9 change "unfoled" to --unfolded--

Col. 7, Line 35 change "rasises" to --raises--

Col. 8, Line 9 change "showin" to --shown--

Claim 4, Col. 10, Line 15 change "poinst" to --point--

Signed and Sealed this

*Twenty-ninth* Day of *July 1986*

[SEAL]

*Attest:*

DONALD J. QUIGG

*Attesting Officer*

*Commissioner of Patents and Trademarks*